US007265324B2

(12) United States Patent
Ozawa et al.

(10) Patent No.: US 7,265,324 B2
(45) Date of Patent: Sep. 4, 2007

(54) FLEXIBLE HEATING SHEET

(75) Inventors: Hideki Ozawa, Chiba (JP); Shigeru Yamamoto, Chiba (JP); Michimasa Shimizu, Tokyo (JP); Shuichi Hashiguchi, Tokyo (JP); Hideharu Watakabe, Yamaguchi (JP)

(73) Assignee: Ube Industries, Ltd., Yamaguchi (JP)

( * ) Notice: Subject to any disclaimer, the term of this patent is extended or adjusted under 35 U.S.C. 154(b) by 0 days.

(21) Appl. No.: 10/855,443

(22) Filed: May 28, 2004

(65) Prior Publication Data

US 2004/0238527 A1 Dec. 2, 2004

(30) Foreign Application Priority Data

May 28, 2003 (JP) ..... 2003-150332

(51) Int. Cl.
*H05B 3/34* (2006.01)

(52) U.S. Cl. ..... 219/549; 219/542; 219/544; 219/552; 428/473.5

(58) Field of Classification Search ..... 219/549, 219/535, 542, 544, 552, 247; 428/473.5, 428/458; 38/93; 156/52
See application file for complete search history.

(56) References Cited

U.S. PATENT DOCUMENTS 3,511,728 A * 5/1970 Ruffing et al. ..... 156/52
4,543,295 A * 9/1985 St. Clair et al. ..... 428/458
4,856,212 A * 8/1989 Dikoff ..... 38/93
6,605,366 B2 * 8/2003 Yamaguchi et al. ..... 428/473.5

FOREIGN PATENT DOCUMENTS

DE 2129468 * 1/1973

* cited by examiner

*Primary Examiner*—Robin Evans
*Assistant Examiner*—Leonid Fastovsky
(74) *Attorney, Agent, or Firm*—Nixon Peabody LLP; Jeffrey L. Costellia

(57) ABSTRACT

A flexible heating sheet is composed of two heat fusible aromatic polyimide films and an electric heating element having an electric source-connecting terminal at each end which intervenes between the heat fusible aromatic polyimide films, in which each heat fusible aromatic polyimide film is covered with a heat resistant aromatic polyimide film.

18 Claims, 2 Drawing Sheets

FLEXIBLE HEATING SHEET

FIELD OF THE INVENTION

This invention relates to a flexible heating sheet. Particularly, the invention relates to a flexible heating sheet which is easily bendable and employable for heating an object at elevated temperatures.

BACKGROUND OF THE INVENTION

It is known that pipe systems of analytical apparatus such as liquid chromatography apparatus or a mass spectograph and pipe systems (for transporting a processing liquid) of a semi-conductor manufacturing machine is heated by means of a flexible heating sheet.

Heretofore, a flexible heating sheet composed of two heat resistant films and an electric heating element such as a nichrom wire and a stainless steel wire intervening between the heat resistant films. The electric element has an electric source-connecting terminal at each end. The heat resitant film is a glass cloth or a silicone resin film. The glass cloth has poor insulating property. The silicone resin film should be formed to have an enough thickness such as 1 mm thick or more. Moreover, the silicone resin film is heat resistant only up to 200° C.

JP2001-15254 A describes a flexible heating sheet comprising an electric heating element covered with a heat resistant aromatic polyimide film on both sides. The electric heating element is sandwitched between the heat resistant aromatic polyimide film via an adhesive layer.

It is an object of the present invention to provide a flexible heating sheet having improved heat resistance so that the flexible heating sheet can be employed under conditions invoving elevated temperatures.

SUMMARY OF THE INVENTION

The present invention resides in a flexible heating sheet comprising two heat fusible aromatic polyimide films and an electric heating element having an electric source-connecting terminal at each end thereof which intervenes between the heat fusible aromatic polyimide films, each heat fusible aromatic polyimide film being covered with a heat resistant aromatic polyimide film.

The invention further resides in a flexible heating sheet comprising two heat fusible aromatic polyimide films and an electric heating element having an electric source-connecting terminal at each end thereof which intervenes between the heat fusible aromatic polyimide films, at least on heat fusible aromatic polyimide film being covered with a heat resistant foamed polymer film.

Preferred embodiments of the present invention are described below.

(1) The electric heating element is in the form of a circuit.

(2) The heat fusible aromatic polyimide film has a glass transition temperature of 200° C. or higher.

(3) The heat fusible aromatic polyimide film is fusible at a temperature in the range of 300 to 400° C.

(4) The heat fusible aromatic polyimide film comprises a product of reaction of a diamine compound comprising 1,3-bis(4-aminophenoxy)benzene and a tetracarboxylic acid compound comprising 2,3,3',4'-biphenyltetracarboxylic dianhydride and 3,3',4,4'-biphenyltetracarboxylic dianhydride.

(5) The heat resistant aromatic polyimide film has no glass transition temperature at temperatures lower than 300° C.

(6) The heat resistant aromatic polyimide film comprises a product of reaction of a diamine compound comprising p-phnenylenediamine and a tetracarboxylic acid compound comprising 3,3',4,4'-biphenyltetracarboxylic dianhydride.

(7) Each of the heat resistant aromatic polyimide film is covered with a heat fusible aromatic polyimide film.

(8) The heat resistant foamed polymer film has a foamed aromatic polyimide films.

The flexible heating sheet of the invention is employable for heating pipe systems of analytical apparatus such as liquid chromatography apparatus or a mass spectograph and pipe systems (for transporting a processing liquid) of a semi-conductor manufacturing machine is heated by means of a flexible heating sheet. The flexible heating sheet of the invention is also employable for heating a fuel cell.

DETAILED DESCRIPTION OF THE INVENTION

The present invention is hereinbelow described in detail by referring to the attached drawings.

Figure 1:
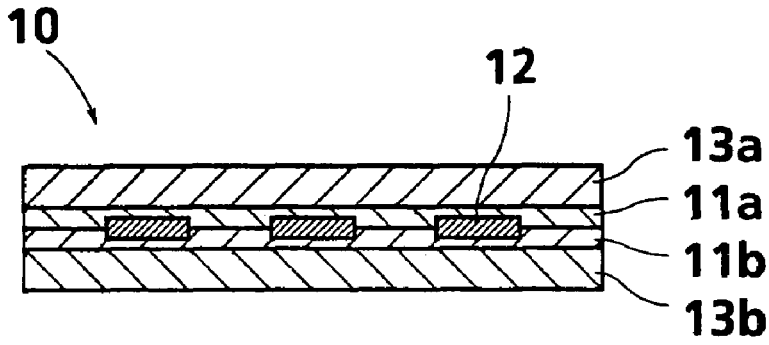
FIG. 1 illustrates a typical structure of a flexible heating sheet of the invention.

FIG. 1 illustrates a typical structure of a flexible heating sheet of the invention. The flexible heating sheet 10 is composed of a pair of heat fusible polyimide films 11*a*, 11*b*, and an electric heating element 12 intervening between the polyimide films 11*a*, 11*b*. Each of the heat fusible polyimide films 11*a*, 11*b* is covered with a heat resistant polyimide film 13*a*, 13*b*, respectively.

Figure 2:
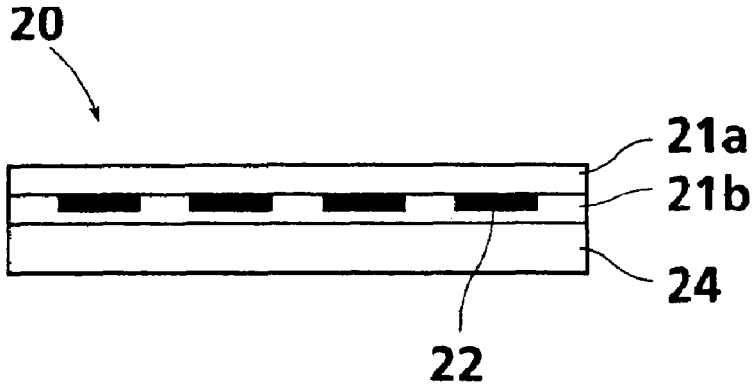
FIG. 2 illustrates another structure of a flexible heating sheet of the invention.

FIG. 2 illustrates another typical structure of a flexible heating sheet of the invention. The flexible heating sheet 20 is composed of a pair of heat fusible polyimide films 21*a*, 21*b*, and an electric heating element 22 intervening between the polyimide films 21*a*, 21*b*. The heat fusible polyimide films 21*b*is covered with a heat resistant foamed polymer film 24.

Figure 3:
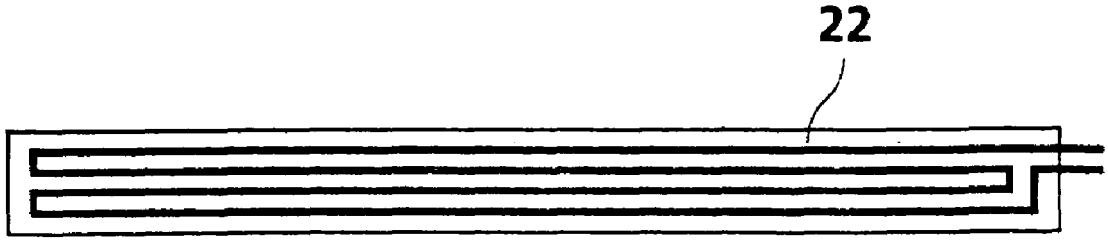
FIG. 3 illustrates a flexbile heating sheet of the invention in which the electric heating element is in the form of a circuit.

FIG. 3 is a plan view of the flexible heating sheet of FIG. 2 and the electric heating element 22 is in the form of circuit having at each eand a terminal connecting to an electric source.

Figure 4:
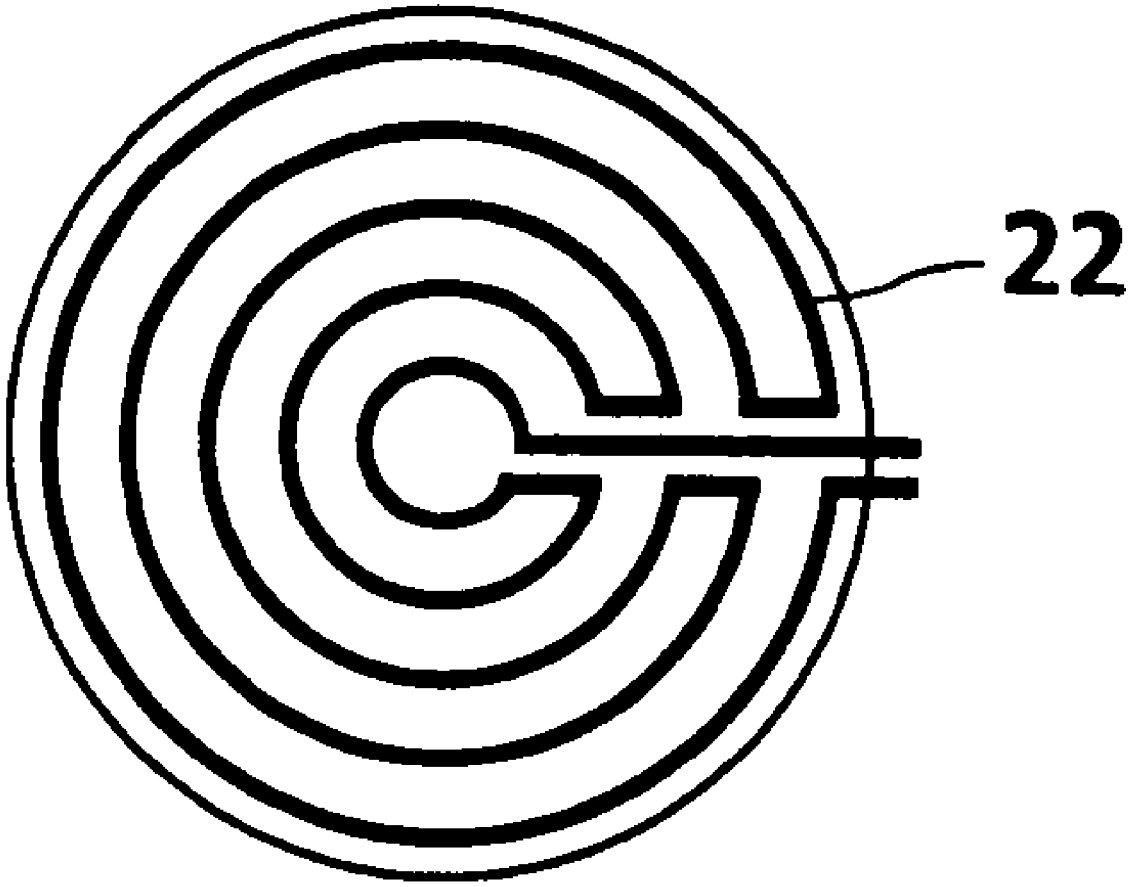
FIG. 4 illustrates a flexbile heating sheet of the invention in which the electric heating element is in the form of a circuit.

FIG. 4 is a plan view of the flexible heating sheet having an electric heating element 22 is in the form of different circuit pattern.

In the flexible heating sheet of the invention, the electric heating element can be any one of known electric heating element such as a metal wire in the form of a straight line or a circuit pattern. The metal can be nichrom, stainless steel, Kanthal alloy, Inconel alloy, or cast iron. It is preferred to employ a metal material showing a resistance of $30\times10^{-6}$ Ω·cm or higher. The electric heating element preferably has a thickness of 5 to 100 μm (more preferably 5 to 50 μm) and a width of 10 μm to 20 mm.

In the flexible heating sheet of the invention, the heat fusible aromatic polyamide film preferably has a glass transition temperature of 200° C. or higher (more preferably 200 to 275° C.), and is fusible at a temperature in the range of 300 to 400° C.

The heat fusible aromatic polyimide film preferably comprises a product of reaction of a diamine compound comprising 1,3-bis(4-aminophenoxy)benzene and a tetra-carboxylic acid compound comprising 2,3,3',4'-biphenyltetracarboxylic dianhydride and 3,3',4,4'-biphenyltetracarboxylic dianhydride.

Alternatively, the heat fusible aromatic polyimide film can be made of one or more of the following reaction products.

1) a reaction product obtainable from 1,3-bis (4-aminophenoxy)-2,2-dimethylpropane and 4,4'-oxydiphthalic dianhydride.

2) a reaction product obtainable from 1,3-bis (4-aminophenoxy)benzene and 4,4'-oxydiphthalic dianhydride.

3) a reaction product obtainable from 1,3-bis (4-aminophenoxy)benzene and 3,3',4,4'-benzophenonetetra-carboxylic dianhydride.

4) a reaction product obtainable from 3,3-diamino-benzophenone and and 3,3',4,4'-benzophenonetetracarboxylic dianhydride.

5) a reaction product obtainable from a diamine compound comprising 1,3-bis(4-aminophenoxy)benzene and a tetracarboxylic compound comprising 12-25 mol. % of pyro-mellitic dianhydride, 5-15 mol. % of 3,3',4,4'-benzopheneonetetracarboxylic dianhydride, and the remainder of 3,3',4,4'-biphenyltetracarboxylic dianhydride, and showing an endothermic peak (by fusion) in DSC measurement.

The heat fusible aromatic polyimide film preferably has a thickness of 1 to 10 μm, more preferably 2 to 5 μm.

In the flexible heating sheet of the invention, the heat resistant aromatic polyimide film preferably has no glass transition temperature at temperatures lower than 300° C.

The heat resistant aromatic polyimide film preferbly comprises a product of reaction of a diamine compound comprising p-phnenylenediamine and a tetracarboxylic acid compound comprising 3,3',4,4'-biphenyltetracarboxylic dianhydride. The diamine compound may further comprise a relatively small amount of 4,4'-diaminodiphenyl ether, and the tetracarboxylic acid compound may further comprise a relatively small amount of pyromellitic dianhydride.

Alternatively, the heat resistant aromatic polyimide film be made of one or more of the following reaction products.

1) a reaction product obtainable from pyromellitic dianhydride and a combination of p-phenylene diamine and 4,4'-diaminodiphenyl ether.

2) a reaction product obtainable from a combination of 3,3',4,4'-benzophenonetetracarboxylic dianhydride and pyromellitic dianhydride and a combination of p-phenylene diamine and 4,4'-diaminodiphenyl ether.

The heat resistant aromatic polyimide film preferably has a thickness of 5 to 100 μm, more preferably 7 to 50 μm.

The heat fusible aromatic polyimide film and the covering heat resistant aromatic polyimide film are preferably prepared in the form of a laminated film before manufacturing the flexible polyimide sheet. The laminated film can be prepared by the known co-extrusion process using the corresponding precursor polyamic acid solutions of the polyimides.

The covering heat resistant aromatic polyimide film can be further covered with a heat fusible aromatic polyimide film which can be the same as that placed in contact with the electric heating element.

Alternatively, the heat fusible aromatic polyimide film of the flexible polyimide sheet can be covered with a heat resistant foamed polymer film. The heat resistant foamed polymer film preferably is a foamed polyimide film which can be prepared from the aforementioned heat resistant polyimide having a foaming ratio of 1.5 to 180.

The electric heating element in the form of a circuit can be installed between a pair of the heat fusible aromatic polyimide films in the following manner:

1) A previously formed heating element in the form of a circuit (a space between adjoining wirings is generally set in the range of 50 μm to 20 mm)is placed between a pair of a laminated film composed of a pair of heat fusible aromatic polyimide films and a heat resistant aromatic polyimide film intervening between the fusible films, and the formed composite is pressed under heating.

2) A plain metal foil is placed on a laminated film composed of a pair of heat fusible aromatic poly-imide films and a heat resistant aromatic polyimide film intervening between the fusible films, the placed metal foil is etched on the fusible film to form a circuit pattern, placing another laminated film composed of a pair of heat fusible aromatic polyimide films and a heat resistant aromatic poly-imide film intervening between the fusible films on the etched metal foil, and finally the formed composite is pressed under heating under the condition that the etched metal foil is airtightly sealed to almost completely expel air from the interface between the etched metal foil and the heat fusible aromatic polyimide films. The resulting flexible heating sheet generally has a small flat protrusion in the area over the wiring.

The invention is further described by the following examples.

EXAMPLE 1

A pair of multilayer polyimide films [heat fusible aromatic polyimide film (4 μm)/heat resistant polyimide film (17 μm)/heat fusible aromatic polyimide film (4 μm)] was prepared from a combination of 1,3-bis(4-aminophenoxy) benzene, 2,3,3',4'-biphenyltetracarboxylic dian-hydride and 3,3',4,4'-biphenyltetracarboxylic dianhydride (100:82:22) for the heat fusible film and a combination of p-phenylenediamine and 3,3',4,4'-biphenyltetracarb-oxylic dianhydride (1000:998).

On one of the multilayer polyimide film was placed a stainless steel foil (thickness 20 μm, SUS304HTA) and pressed at a pressure of 5 MPa after preheating at 340° C. for 5 min. A mask was placed on the stainless steel foil and the foil was etched using an aqueous ferrous iron solution, to form a circuit pattern.

On the etched stainless foil in the form of a circuit pattern was placed another multilayer polyimide film and pressed at a pressure of 5 MPa after preheating at 340° C. for 5 min.

Thus manufactured heating sheet was satisfactorily flexible and can be heated up to 350° C. with no problem. Further, there occurred no problem in a long term run under heating at approx. 275° C.

EXAMPLE 2

A stainless steel foil (thickness 20 μm, SUS304HTA) in the form of a circuit pattern was placed between a pair of multilayer polyimide films prepared in the same manner as in Example 1, to manufacture a heating sheet.

Thus manufactured heating sheet was satisfactorily flexible and can be heated up to 350° C. with no problem. Further, there occurred no problem in a long term run under heating at approx. 275° C.

What is claimed is:

1. A flexible heating sheet comprising an electric heating circuit element having an electric source-connecting terminal at each end thereof, and two aromatic polyimide sheets each comprising a heat fusible aromatic polyimide film and a heat resistant aromatic polyimide film attached to the heat fusible aromatic polyimide film, in which the two aromatic polyimide sheets are arranged opposite to each other under such condition that one heat fusible aromatic polyimide film is brought into contact with another heat fusible aromatic polyimide film, and in which the electric heating circuit element is airtightly sealed between the two heat fusible aromatic polyimide films under such condition that each electric source-connecting terminal of the electric heating circuit element is exposed from the aromatic polyimide sheets.

2. The flexible heating sheet of claim 1, wherein the heat fusible aromatic polyimide film has a glass transition temperature of 200° C. or higher.

3. The flexible heating sheet of claim 1, wherein the heat fusible aromatic polyimide film is fusible at a temperature in the range of 300 to 400° C.

4. The flexible heating sheet of claim 1, wherein the heat fusible aromatic polyimide film comprises a product of reaction of a diamine compound comprising 1,3-bis(4-aminophenoxy)benzene and a tetracarboxylic acid compound comprising 2,3,3',4'-biphenyltetracarboxylic dianhydride and 3,3',4,4'-biphenyltetracarboxylic dianhydride.

5. The flexible heating sheet of claim 1, wherein the heat fusible aromatic polyimide film has a thickness of 1 to 10 μm.

6. The flexible heating sheet of claim 1, wherein the heat resistant aromatic polyimide film has no glass transition temperature at temperatures lower than 300° C.

7. The flexible heating sheet of claim 1, wherein the heat resistant aromatic polyimide film comprises a product of reaction of a diamine compound comprising p-phnenylenediamine and a tetracarboxylic acid compound comprising 3,3',4,4'-biphenyltetracarboxylic dianhydride.

8. The flexible heating sheet of claim 1, wherein each of the heat resistant aromatic polyimide film is covered with a heat fusible aromatic polyimide film.

9. The flexible heating sheet of claim 1, wherein, between the source-connecting terminals, the electric heating circuit element essentially consists of material formed as a one-piece loop.

10. The flexible heating sheet of claim 9, wherein the material formed as the one-piece loop is selected from the group consisting of nichrom, stainless steel, Kanthal alloy, Inconel alloy, and cast iron.

11. A flexible heating sheet comprising an electric heating circuit element having an electric source-connecting terminal at each end thereof, and two heat fusible aromatic polyimide films, in which the two heat fusible aromatic polyimide films are arranged opposite to each other, and in which the electric heating circuit element is airtightly sealed between the two heat fusible aromatic polyimide films under such condition that each electric source-connecting terminal of the electric heating circuit element is exposed from the heat fusible aromatic polyimide films, at least one heat fusible aromatic polyimide film being covered with a heat resistant foamed polymer film.

12. The flexible heating sheet of claim 11, wherein the heat fusible aromatic polyimide film has a glass transition temperature of 200° C. or higher.

13. The flexible heating sheet of claim 11, wherein the heat fusible aromatic polyimide film is fusible at a temperature in the range of 300 to 400° C.

14. The flexible heating sheet of claim 11, wherein the heat fusible aromatic polyimide film comprises a product of reaction of a diamine compound comprising 1,3-bis(4-aminophenoxy)benzene and a tetracarboxylic acid compound comprising 2,3,3',4'-biphenyltetracarboxylic dianhydride and 3,3',4,4'-biphenyltetracarboxylic dianhydride.

15. The flexible heating sheet of claim 11, wherein the heat fusible aromatic polyimide film has a thickness of 1 to 10 μm.

16. The flexible heating sheet of claim 11, wherein the heat resistant foamed polymer film has a foamed aromatic polyimide films.

17. The flexible heating sheet of claim 11, wherein, between the source-connecting terminals, the electric heating circuit element essentially consists of material formed as a one-piece loop.

18. The flexible heating sheet of claim 17, wherein the material formed as the one-piece loop is selected from the group consisting of nichrom, stainless steel, Kanthal alloy, Inconel alloy, and cast iron.

* * * * *